US005674136A

United States Patent [19]

Gorse

[11] Patent Number: 5,674,136

[45] Date of Patent: Oct. 7, 1997

[54] GOLF CLUB

[76] Inventor: Peter Gorse, 3 Linton Close, Heelands, Milton Keynes, United Kingdom

[21] Appl. No.: 643,165

[22] Filed: May 3, 1996

[30] Foreign Application Priority Data

May 5, 1995 [GB] United Kingdom ..... 9509221

[51] Int. Cl.[6] ..... A63B 53/04

[52] U.S. Cl. ..... 473/327; 473/328

[58] Field of Search ..... 473/314, 327, 473/328, 256, 349, 228

[56] References Cited

U.S. PATENT DOCUMENTS

| | | | |
|---|---|---|---|
| 1,657,473 | 1/1928 | Howard | 473/314 |
| 2,041,676 | 5/1936 | Gallagher | 473/328 |
| 2,088,095 | 7/1937 | Sargent | 473/314 |
| 3,595,577 | 7/1971 | Hodge | 473/327 |
| 3,761,095 | 9/1973 | Thompson | 473/328 |
| 3,961,796 | 6/1976 | Thompson | 473/328 |
| 3,997,170 | 12/1976 | Goldberg | 473/327 |
| 4,065,133 | 12/1977 | Gordos | 473/328 |
| 4,157,830 | 6/1979 | Taylor | 473/314 |
| 5,271,622 | 12/1993 | Rogerson | 473/327 |

*Primary Examiner*—Sebastiano Passaniti

*Attorney, Agent, or Firm*—Wood, Phillips, VanSanten, Clark & Mortimer

[57] ABSTRACT

A golf club (10) having a club head (16), the head having a face (18), a top portion (20) and a sole (22), the sole having at least one channel (32,34) defined thereon, and the or each channel having a cambered surface (44). A golf club having a club head, the head having a face, a top portion and a sole, the sole having at least one channel defined thereon, the or each channel (32,34) increasing in size away from the face. A golf club comprising a shaft and a club head, the club further comprising a streamlined hosel (14) between the shaft and club head which is asymmetrical thereby to produce a sideways force on the golf club while swinging the golf club.

21 Claims, 5 Drawing Sheets

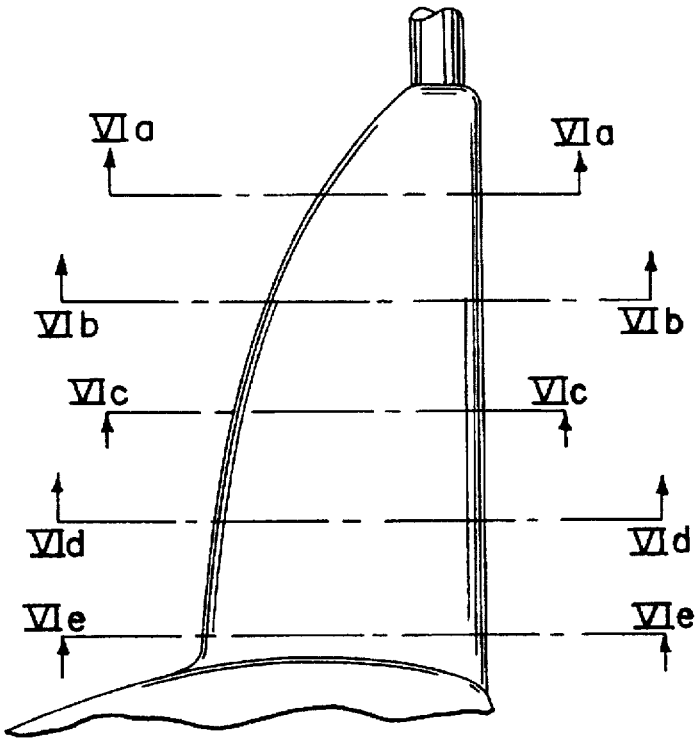
FIG. 5
FIG. 7
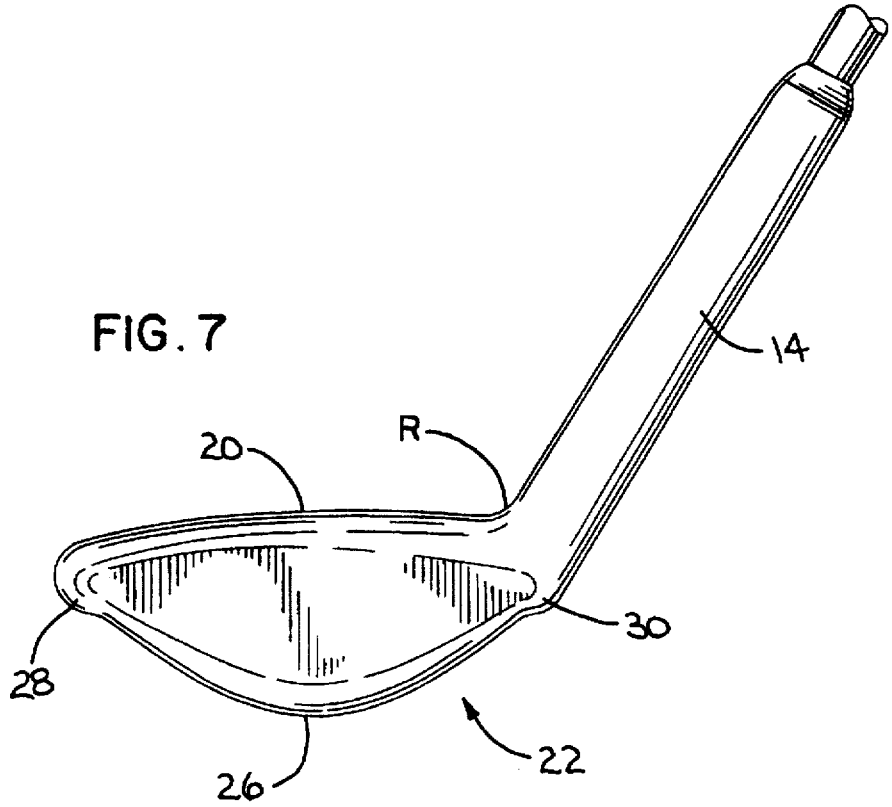

GOLF CLUB

FIELD OF THE INVENTION

The invention relates to golf clubs and particularly to golf clubs having features to improve aerodynamic performance.

DESCRIPTION OF RELATED ART

Various attempts have been made to improve the aerodynamic performance of golf clubs. These include reducing the size of tie club head, streamlining the hosel of a club and dimpling the club head as with a golf ball.

SUMMARY OF THE INVENTION

It is an object of the invention to provide an improved golf club.

According to one aspect of the invention there is provided a golf club having a club head, the head having a face, a top portion and a sole, the sole having at least one channel defined thereon, and the or each channel having a cambered surface. Preferably the cambered surface comprises a cambered profile between the face trod rear of the club head. The cambered surface preferably has a greater extent of camber near the face of the club head than the rear. In this way a ground effect is obtained to improve the flow characteristics of air over the club as it is swung towards the ground.

In a preferred form the or each channel increases in size away from the face.

Accordingly to another aspect of the invention, there is provided a golf club having a club head, the head having a face, a top portion and a sole, the sole having at least one channel defined thereon, the or each channel increasing in size away from the face. Preferably, the channels taper outwardly towards the rear of the club head.

In a preferred embodiment the sole has a ridge thereon which tapers inwardly away from the face so as to define two channels.

Provision of the channels further improves the flow characteristics and facilitates club head stability during a swing.

Where the ridge defines the channels, the sole may be provided with shoulders or fins, one each side of the club head to define the outer edge of each channel. Preferably the sole comprises a lateral shoulder which shoulder defines the outside of a lateral channel. The sole can comprise a lateral shoulder on each of its sides.

The channels are preferably of substantially equal dimensions. The channels are preferably provided substantially symmetrically about the ridge. The sole can comprise two channels and a central ridge.

A leading edge defined between the face and the top portion is preferably contoured to ensure attached flow over the top portion of the club during a swing. Preferably the said leading edge is pan circular and of a suitable radius. The radius may be between 4 mm and 6 mm.

A leading edge defined between the face and the sole may also be contoured to ensure attached flow at the entry to the channels. Preferably the leading edge is part circular and of a suitable radius. The radius may be between 4 mm and 6 mm.

The top portion preferably slopes gently from the face to the rear of the club.

In that way laminar flow over the top of the club during a swing is encouraged.

The club head may taper to a point away from the face to define a substantially triangular form in plan. This construction reduces the wake formed by the club head during swinging.

The sole of the club preferably slopes upwardly from the face towards the rear of the club, at a preferable radius of 150 mm, or at an angle between 17° and 27° and preferably 22°.

According to a further aspect of the invention, the club may include a hosel, which is streamlined and disposed to produce a sideways force on the golf club whilst swinging the golf club. The hosel can be asymmetric in the hosel plane perpendicular to the shaft longitudinal axis for example the hosel can be cambered, i.e have a greater area on one side than the other side with respect to the chord line. Preferably the hosel chord line is inclined at an angle with respect to the longitudinal club head axis to provide an "angle of attack". The hosel can also be tapered inwardly away from the club head. Preferably the hosel is a cambered aerofoil section set at a low angle of attack, for example, below 30° to provide adequate side force without excessive drag. One of the shoulders may extend from a base of the hosel.

A further aspect of the invention provides a golf club comprising a shaft and a club head, the club head further comprising a streamlined hosel having a center-line which is not parallel to the club head longitudinal axis.

Any of the individual features of each of the aspects of the invention can be used in combination with one another to provide certain benefits. Indeed, a significant benefit of a golf club according to the invention is that the combination of various aerodynamic features provides optimum, i.e. laminar, air flow over the club head as it approaches the ground. The combination of features includes: channels in the sole, cumbered channels, flared channels, lateral shoulders, central sole ridge, suitable face leading edge radii, gently sloping club head top surface, aerofoil hosel smooth radius between club head top surface and hosel, and reduced cross-sectional area at the rear of club head.

BRIEF DESCRIPTION OF THE DRAWINGS

A golf club in accordance with the invention will now be described in detail by way of example and with reference to the accompanying drawings, in which:

FIG. 5 is an elevation of the hosel with the rest of the club omitted for clarity;

FIG. 7 is a front elevation of the club head and hosel.

DETAILED DESCRIPTION OF THE PREFERRED EMBODIMENTS

Figure 1:
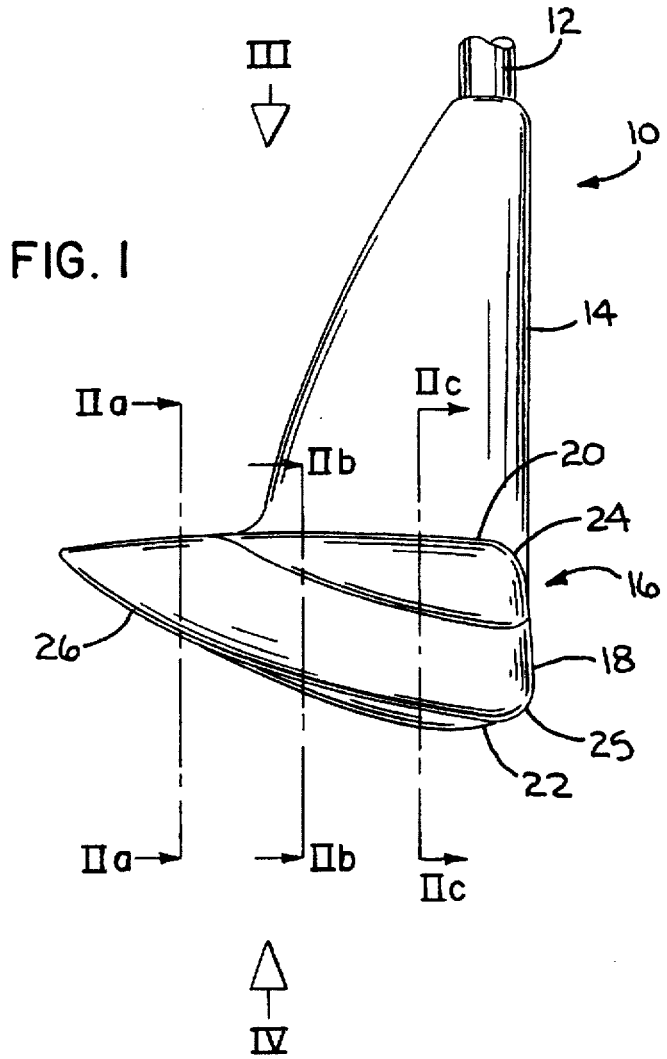
FIG. 1 is an elevation of part of a golf club according to the invention.

In FIG. 1 a golf club 10 is shown comprising a shaft 12, a hosel 14 and a club head 16. Only part of the shaft 12 is shown in FIG. 1.

The club head 16 has a face 18, a top portion 20 and a sole 22. A leading edge 24 defined between the face 18 and top portion 20 has a radius sufficient to ensure attached airflow over the top portion as the club is being swung. Likewise, a leading edge 25 defined between the face 18 and the sole 22 has a radius which ensures attached flow into the channels on the sole 22 of the club 10. Each leading edge 24,25 preferably has a radius between 3 mm and 7.5 mm and more preferably between 4 mm and 6 mm.

The sole 22 of the head 16 has a central ridge 26 which tapers from a broad ridge at the face 18 to a sharp ridge towards the rear of the club head. The ridge 26 is best illustrated in FIGS. 2*a*, 2*b*, 2*c* and FIG. 4. The sole 22 also has a lateral shoulder 28 extending along its edge spaced from the hosel and tapering to a point away from the face 18.

A second shoulder 30 is defined by the base of the hosel 14, again extending along the edge of the club and tapering to a point away from the face 18.

The shoulders 28,30 and the central ridge on the sole 22 define respective channels 32,34. The channels 32,34 each have a cambered surface, best illustrated in FIG. 4*a*, for the air travelling over the club during a swing. FIG. 4*a* shows schematically a section of the club head 16 with emphasis on the shape of the cambered sure, ace 44 on the sole which is shown with respect to an illustrative straight line 44*a*. The channels 32,34 have respective entrances 36,38 and respective exits 40,42. The channels 32,34 widen from the face 18 towards the fear of the club such that the entrances 36,38 are smaller than the exits 40,42.

Figure 3:
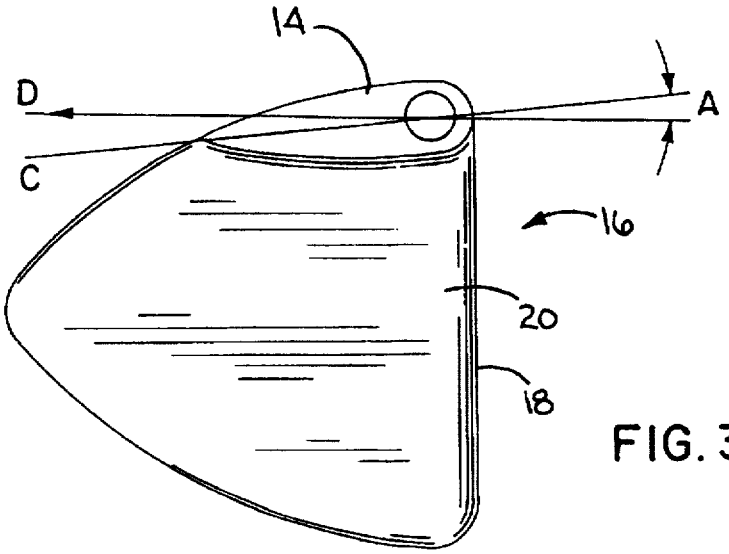
FIG. 3 is a plan view of the club looking in the direction of arrow III in FIG. 1.
Figure 2A:
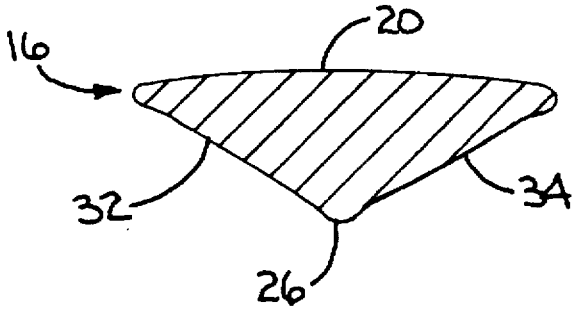
FIGS. 2*a*, 2*b* and 2*c* are sectional views through the club head on lines IIa—IIa, IIb—IIb and IIc—IIc respectively.
Figure 2B:
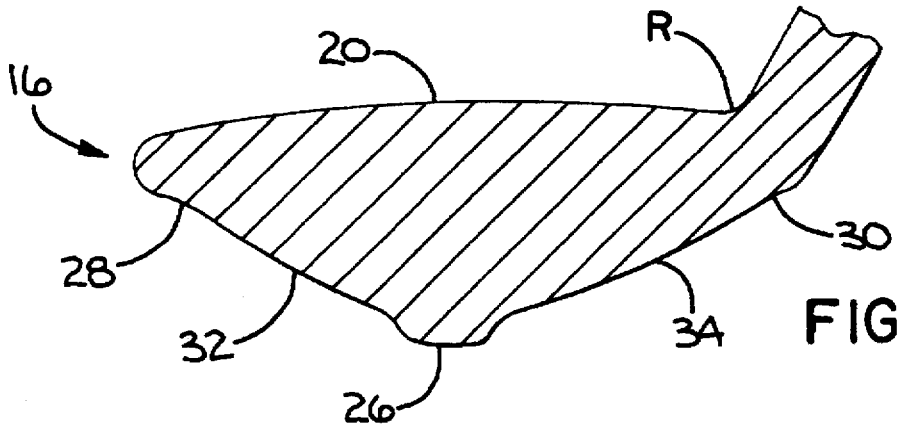
Figure 2C:
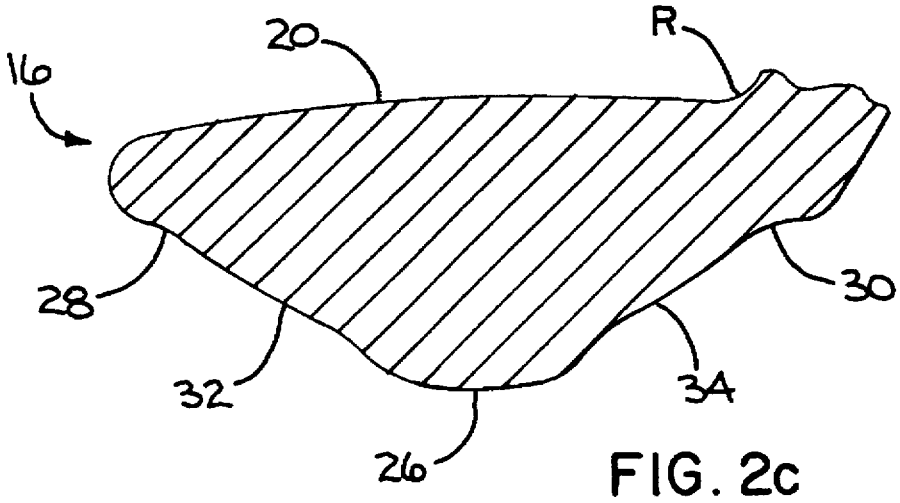
Figure 4:
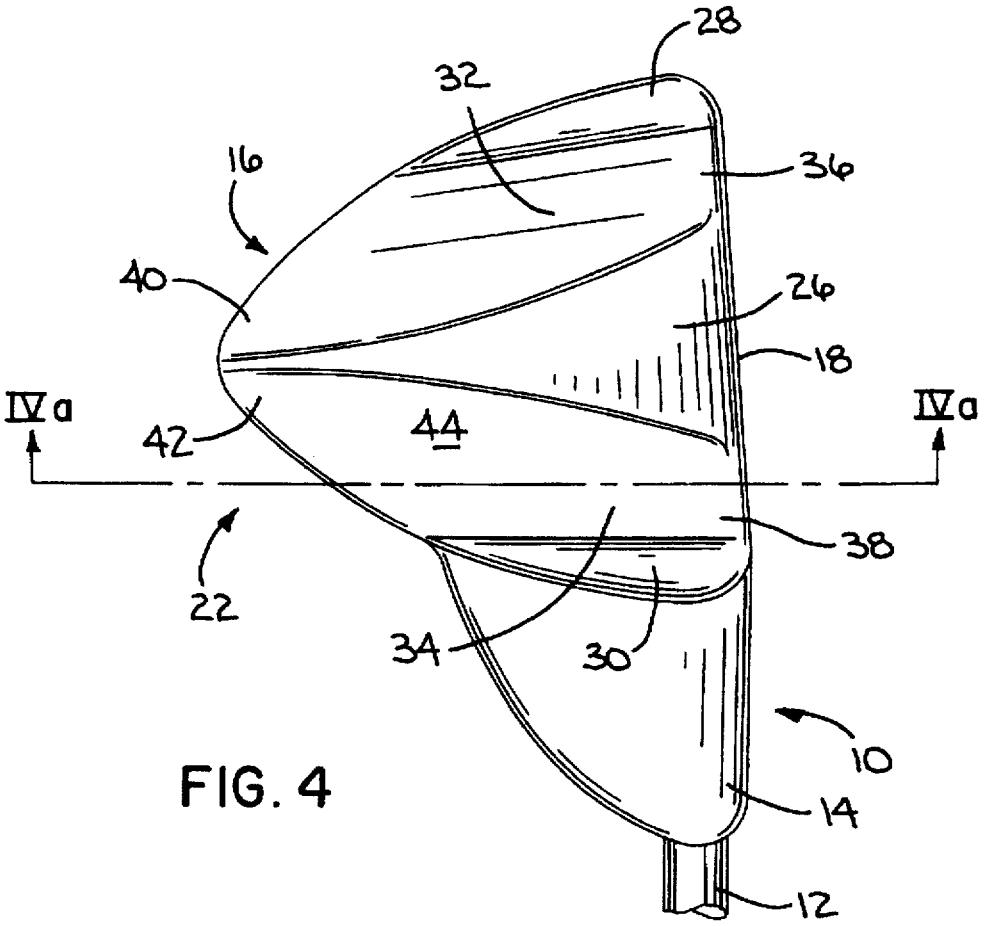
FIG. 4 is a plan view of the sole of the club looking substantially in the direction of arrow IV in FIG. 1.
Figure 4A:
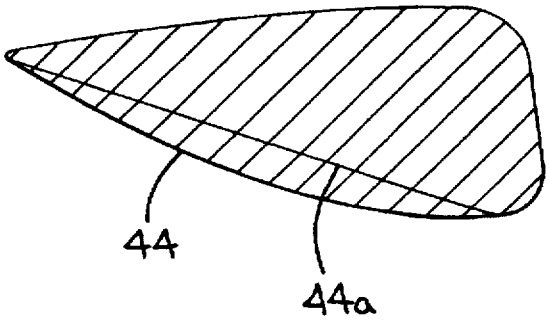
FIG. 4*a* is a sectional view through the sole of the club head on line IVa—IVa.

As shown in FIGS. 3 and 4 the club head 16 tapers to a point away front the face 18 so as to define a substantially triangular form, in plan. Furthermore, the central ridge 26 of the sole 22 of the club head 16 slopes upwardly towards the rear of the club, preferably with a radius of 150 mm.

FIGS. 5 and 6 show the hosel 14 in more detail. The hosel can be symmetrical about its chord line. However, the hosel 14 shown is a cambered aerofoil such that there is more cross-sectional area on one side of the chord line. In other words, it is not symmetrical about the chord line, as shown in FIGS. 6*a* to 6*d*. And in this case the hosel center-line, which is the line which passes through all points equidistant from both sides of the hosel, is not a straight line. The extent of cambering determines the magnitude of sideways force generated whilst swinging the golf club.

The hosel 14 can also have an angle of attack as shown in FIG. 3. The angle of attack A is measured between the chord line C and the direction of the airflow D which in this case is a direction perpendicular to face 18 which is parallel to the longitudinal axis of the club head. Here the angle of attack A is in the order of 10°. Also, it is noted that neither the hosel center-line nor chord line are parallel to the club head longitudinal axis D in this case.

Figure 6A:
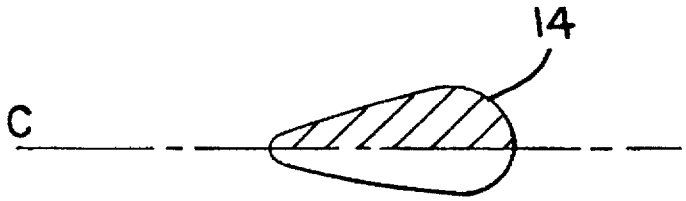
FIGS. 6*a*, 6*b*, 6*c* and 6*d* are sectional views through the hosel on lines VIa—VIa, VIb—VIb, VIc—VIc and VId—VId respectively.
Figure 6B:
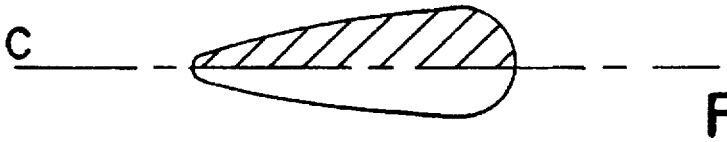
Figure 6C:
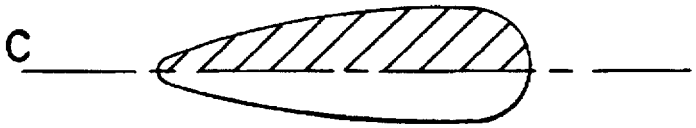
Figure 6D:
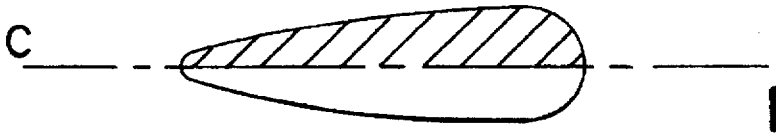
Figure 6E:
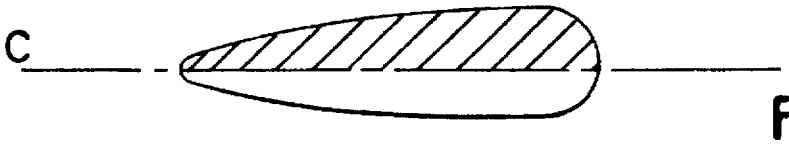

The hosel 14 tapers from a long aerofoil section adjacent the club 16 as shown in FIG. 6*d* to a short aerofoil section adjacent the shaft 12 as shown in FIG. 6*a*. The joining of the hosel 14 and the club head 16 has a sufficient radius R (see FIG. 7) to ensure attachment of air flow over the hosel 14 and head 16. Preferably the radius is about 8 mm. The hosel surface area can also be varied, for example to increase side forces a larger hosel 14 which extends between the face 18 and rear of the club head can be used. This can be done by extending the average chord length of the aerofoil hosel. The extent of vertical taper can also be varied such that in the extreme the chord length is uniform along the span of the aerofoil. This can be useful since golfing regulation stipulate a maximum height (span) of the hosel.

During a swing air can move past the club head and hosel at over 100 mph. The club head 16 and hosel 14 are designed to improve the aerodynamic characteristics of the club as it travels through the air and as it comes into contact with a ball. Airflow over the top portion 20 of the club head remains attached due to its gentle slope and size of the leading edge 24. Similarly, airflow remains attached entering the channels 32,34 due to the radius 25.

The airflow over the sole 22 of the club head 16 enters the channels 32,34 through the entrances 36,38. The air then flows along the cambered channels 32,34 and out of the exits 40,42. A golfer should generate maximum club head speed at the point of impact with the golf ball. To encourage this, as the club head approaches the ground, the defined channels 32,34 induce laminar flow which improves the aerodynamic flow characteristics of the air and improves club stability.

As more of the airflow remains attached over the club head the shaping of the rear of the club head 16 becomes important. Accordingly, the club head 16 tapers to a point away from the face 18. That feature reduces the wake caused by the club as it is swung.

The main part of the aerodynamic drag caused by the club head is the pressure drag induced at the rear of the club head 16. Reducing the size of the rear of the club head thus reduces the pressure drag induced thereby.

The aerofoil shaped hosel 14 further improves the flow characteristics over the club. The aerofoil hosel 14 has far better aerodynamic performance than conventional cylindrical hosel's of less cross-sectional area. As well as inducing laminar flow around the hosel it creates less disturbance to the flow over the top portion of the club head. As well as reducing aerodynamic drag an aerofoil hosel having an angle of attack and/or with sufficient cambered surface area can induce side forces, in order to fine tune a golfer's swing. It is possible to design the aerofoil hosel, by changing the camber and/or angle of attack and/or surface area, such that it creates side force towards or away from the golfer in order to correct a recurring fault in the golfer's swing.

What is claimed is:

1. A golf club comprising:

a clubhead having a face for striking a ball, a rear, a smooth top portion, a sole and two sides;

a streamlined hosel attached to the club head and tapering towards the rear of the club head;

the sole having a central ridge between the sides of the club head and a channel on each side of the ridge, which channels are defined by side walls on each of the sides of the channels;

one of the side walls of each of the channels being defined by the ridge and another of the side walls of each of the channels being defined by a shoulder near one of the sides of the club head; and wherein each of the channels comprise a channel surface forming part of the sole of the club head, which channel surface is convexly curved both in a direction from the face to the rear of the club head and in a direction between the channel side walls.

2. A golf club according to claim 1 wherein each of the convex channel surfaces has a greater extent of camber near the face of the clubhead than the rear.

3. A golf club according to claim 1 wherein the channels increase in size away from the face.

4. A golf club according to claim 1 wherein the ridge tapers rearwardly away from the face of the club head.

5. A golf club according to claim 1 wherein the club head tapers to a point away from the face to define a substantially triangular form in plan view.

6. A golf club according to claim 1 wherein the streamlined hosel is disposed asymmetrically with respect to a central symmetry axis passing through the club head from the face to the rear to produce a sideways force on the golf club while swinging the golf club.

7. A golf club according to claim 6 which comprises a shaft having a longitudinal axis and wherein the hosel is asymmetric in a hosel plane perpendicular to the shaft longitudinal axis.

8. A golf club according to claim 7 wherein the hosel is cambered in the hosel plane perpendicular to the shaft longitudinal axis.

9. A golf club according to claim 6 wherein the hosel has a chord line and the hosel chord line is inclined at an angle with respect to the longitudinal club head axis.

10. A golf club according to claim 1, the streamlined hosel having a centerline which is not parallel to the club head longitudinal axis.

11. A golf club according to claim 10 wherein the hosel chord line is not parallel to the club head longitudinal axis.

12. A golf club according to claim 11 having an angle of attack between the hosel chord line and the club head longitudinal axis, which angle of attack is about 10 degrees.

13. A golf club according to claim 1 wherein the sole tapers rearwardly away from the face at a radius of curvature of about 150 mm.

14. A golf club according to claim 1 wherein the sole tapers rearwardly away from the face at an angle of between 17 and 27 degrees.

15. A golf club according to claim 14 wherein the angle of taper is approximately 22 degrees.

16. A golf club according to claim 1 wherein the club head comprises a leading edge between the face and the top portion which leading edge has a radius of curvature between 3 mm and 7.5 mm.

17. A golf club according to claim 16 wherein the radius of curvature of the leading edge is between 4 mm and 6 mm.

18. A golf club according to claim 1 wherein the club head comprises a leading edge between the face and sole, which leading edge has a radius of curvature of between 3 mm and 7.5 mm.

19. A golf club according to claim 18 wherein the radius of curvature of the leading edge is between 4 mm and 6 mm.

20. A golf club according to claim 1 wherein the channels taper to a point away from the face.

21. A golf club according to claim 1 wherein the smooth top portion is gently sloping from the face to the rear of the club head.

* * * * *